US010620558B2

(12) United States Patent
Cohen et al.

(10) Patent No.: US 10,620,558 B2
(45) Date of Patent: Apr. 14, 2020

(54) SECURITY LIQUID ELECTROSTATIC INK COMPOSITION

(71) Applicant: HP Indigo B.V., Amstelveen (NL)

(72) Inventors: Haim Cohen, Modiin (IL); Yaron Grinwald, Meitar (IL); Julia Kornilov, Rehovot (IL); Reut Avigdor, Nes Ziona (IL); Gideon Amir, Nes Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 16/072,470

(22) PCT Filed: Mar. 10, 2016

(86) PCT No.: PCT/EP2016/055092

§ 371 (c)(1),
(2) Date: Jul. 24, 2018

(87) PCT Pub. No.: WO2017/152978

PCT Pub. Date: Sep. 14, 2017

(65) Prior Publication Data

US 2019/0033742 A1 Jan. 31, 2019

(51) Int. Cl.

| | |
|---|---|
| ***G03G 9/12*** | (2006.01) |
| ***G03G 9/13*** | (2006.01) |
| ***G03G 9/135*** | (2006.01) |
| ***G03G 15/01*** | (2006.01) |
| ***G03G 15/10*** | (2006.01) |

(52) U.S. Cl.
CPC ..... *G03G 9/122* (2013.01); *G03G 9/131* (2013.01); *G03G 9/1355* (2013.01); *G03G 15/0121* (2013.01); *G03G 15/10* (2013.01)

(58) Field of Classification Search
CPC ..... G03G 9/122; G03G 9/131; G03G 9/12; G03G 13/013; G03G 13/10
USPC ..... 430/112, 114, 45.2; 106/31.15, 31.64
See application file for complete search history.

(56) References Cited

U.S. PATENT DOCUMENTS

| | | | | |
|---|---|---|---|---|
| 6,610,351 | B2 | 8/2003 | Shchegolikhin et al. | |
| 6,623,902 | B1 | 9/2003 | Ben-Avraham et al. | |
| 6,802,992 | B1 * | 10/2004 | Wieczoreck | C09D 5/22 106/31.14 |
| 7,674,532 | B2 | 3/2010 | Einhorn et al. | |
| 7,682,523 | B2 | 3/2010 | Weisman et al. | |
| 7,919,018 | B2 | 4/2011 | Williams et al. | |
| 7,927,409 | B2 | 4/2011 | Chatow et al. | |
| 2008/0233313 | A1 | 9/2008 | Chatow et al. | |
| 2011/0279866 | A1 * | 11/2011 | Matheson | G06K 15/02 358/1.15 |
| 2012/0064134 | A1 | 3/2012 | Bourke, Jr. et al. | |
| 2014/0162186 | A1 * | 6/2014 | Ganapathiappan | G03G 9/16 430/137.14 |

FOREIGN PATENT DOCUMENTS

| | | |
|---|---|---|
| EP | 0143034 A1 * | 5/1985 |
| WO | WO-2007132214 | 11/2007 |

OTHER PUBLICATIONS

Espacenet nachine-assisted English-language translation of EP0143034 A1 (pub. May 1985) (Year: 1985).*
International Search Report and Written Opinion for the International Publication No. PCT/EP2016/055092 dated Nov. 25, 2016, 10 pages.

* cited by examiner

*Primary Examiner* — Janis L Dote
(74) *Attorney, Agent, or Firm* — HP Inc. Patent Department

(57) ABSTRACT

Described herein is a LEP ink composition comprising a luminescent component, a resin; and a carrier liquid security liquid electrostatic ink composition for printing a security image.

11 Claims, 1 Drawing Sheet

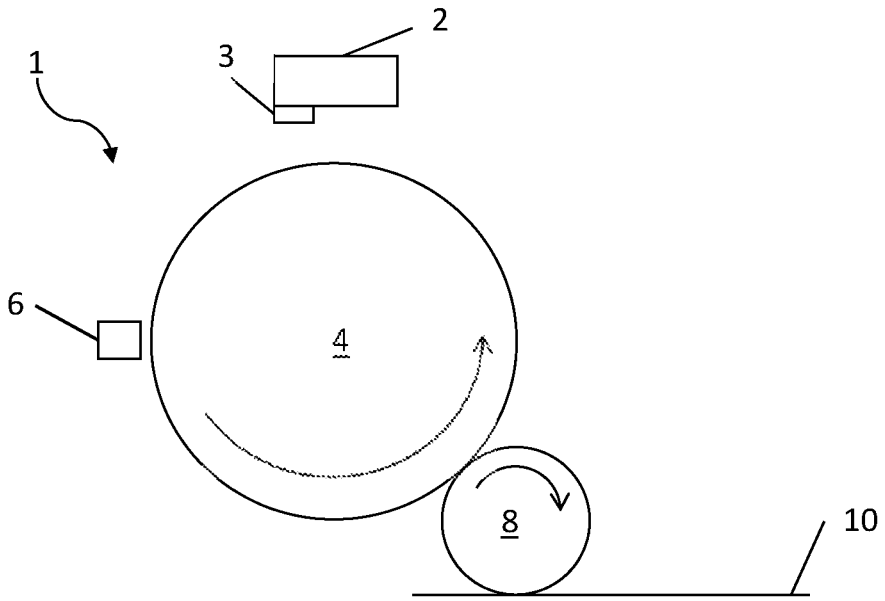
2
3
1
6
4
8
10

SECURITY LIQUID ELECTROSTATIC INK COMPOSITION

BACKGROUND

Electrophotographic printing processes, sometimes termed electrostatic printing processes, generally involve creating an image on a photoconductive surface, applying an ink having charged particles to the photoconductive surface, such that they selectively bind to the image, and then transferring the charged particles in the form of the image to a print substrate.

The photoconductive surface may be on a cylinder and is often termed a photo imaging plate (PIP). The photoconductive surface is selectively charged with a latent electrostatic image having image and background areas with different potentials. For example, an electrostatic ink composition including charged particles in a liquid carrier can be brought into contact with the selectively charged photoconductive surface. The charged particles adhere to the image areas of the latent image while the background areas remain clean. The image is then transferred to a print substrate (e.g. paper) directly or, by being first transferred to an intermediate transfer member, which can be a soft swelling blanket, which is often heated to fuse the solid image and evaporate the liquid carrier, and then to the print substrate.

BRIEF DESCRIPTION OF THE FIGURES

The FIGURE is a schematic illustration of an example of a Liquid Electro Photographic (LEP) printing apparatus for printing an electrostatic ink composition.

DETAILED DESCRIPTION

Before the compositions, methods and related aspects of the disclosure are disclosed and described, it is to be understood that this disclosure is not restricted to the particular process features and materials disclosed herein because such process features and materials may vary somewhat. It is also to be understood that the terminology used herein is used for the purpose of describing particular examples. The scope of the invention is defined by the appended claims and equivalents thereof.

It is noted that, as used in this specification and the appended claims, the singular forms "a," "an," and "the" include plural referents unless the context clearly dictates otherwise.

As used herein, "liquid carrier", "carrier liquid", "carrier," or "carrier vehicle" refers to the fluid in which the polymer resin, luminescent component, charge directors and/or other additives can be dispersed to form a liquid electrostatic ink or electrophotographic ink. Liquid carriers can include a mixture of a variety of different agents, such as surfactants, co-solvents, viscosity modifiers, and/or other possible ingredients.

As used herein, "electrostatic ink composition" generally refers to an ink composition, which may be in liquid form, generally suitable for use in an electrostatic printing process, sometimes termed an electrophotographic printing process. The electrostatic ink composition may include chargeable particles of the resin and a luminescent component dispersed in a liquid carrier, which may be as described herein.

As used herein, "co-polymer" refers to a polymer that is polymerized from at least two monomers.

As used herein, "melt flow rate" generally refers to the extrusion rate of a resin through an orifice of defined dimensions at a specified temperature and load, usually reported as temperature/load, e.g. 190° C./2.16 kg. Flow rates can be used to differentiate grades or provide a measure of degradation of a material as a result of molding. In the present disclosure, "melt flow rate" is measured per ASTM D1238-04c Standard Test Method for Melt Flow Rates of Thermoplastics by Extrusion Plastometer. If a melt flow rate of a particular polymer is specified, unless otherwise stated, it is the melt flow rate for that polymer alone, in the absence of any of the other components of the electrostatic composition.

As used herein, "acidity," "acid number," or "acid value" refers to the mass of potassium hydroxide (KOH) in milligrams that neutralizes one gram of a substance. The acidity of a polymer can be measured according to standard techniques, for example as described in ASTM D1386. If the acidity of a particular polymer is specified, unless otherwise stated, it is the acidity for that polymer alone, in the absence of any of the other components of the liquid toner composition.

As used herein, "melt viscosity" generally refers to the ratio of shear stress to shear rate at a given shear stress or shear rate. Testing is generally performed using a capillary rheometer. A plastic charge is heated in the rheometer barrel and is forced through a die with a plunger. The plunger is pushed either by a constant force or at constant rate depending on the equipment. Measurements are taken once the system has reached steady-state operation. One method used is measuring Brookfield viscosity @ 140° C., units are mPa-s or cPoise. In some examples, the melt viscosity can be measured using a rheometer, e.g. a commercially available AR-2000 Rheometer from Thermal Analysis Instruments, using the geometry of: 25 mm steel plate-standard steel parallel plate, and finding the plate over plate rheometry isotherm at 120° C., 0.01 hz shear rate. If the melt viscosity of a particular polymer is specified, unless otherwise stated, it is the melt viscosity for that polymer alone, in the absence of any of the other components of the electrostatic composition.

A certain monomer may be described herein as constituting a certain weight percentage of a polymer. This indicates that the repeating units formed from the said monomer in the polymer constitute said weight percentage of the polymer.

If a standard test is mentioned herein, unless otherwise stated, the version of the test to be referred to is the most recent at the time of filing this patent application.

As used herein, "liquid electrostatic(ally) printing" or "liquid electrophotographic(ally) printing" generally refers to the process that provides an image that is transferred from a photo imaging substrate or plate either directly or indirectly via an intermediate transfer member to a print substrate, e.g. a paper substrate. As such, the image is not substantially absorbed into the photo imaging substrate or plate on which it is applied. Additionally, "liquid electrophotographic printers" or "liquid electrostatic printers" generally refer to those printers capable of performing electrophotographic printing or electrostatic printing, as described above. A liquid electrophotographic (LEP) printing process may involve subjecting a liquid electrophotographic ink composition to an electric field, e.g. an electric field having a field strength of 1000 V/cm or more, in some examples 1000 V/mm or more.

As used herein, "LEP image" or "printed LEP image" refers to an image which has been printed, e.g. on a print substrate, by liquid electrophotographically printing a LEP ink composition described herein.

As used herein, the term "about" is used to provide flexibility to a numerical range endpoint by providing that a given value may be a little above or a little below the endpoint. The degree of flexibility of this term can be dictated by the particular variable.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not just the numerical values explicitly recited as the end points of the range, but also to include all the individual numerical values or sub-ranges encompassed within that range as if each numerical value and sub-range is explicitly recited. As an illustration, a numerical range of "about 1 wt % to about 5 wt %" should be interpreted to include not just the explicitly recited values of about 1 wt % to about 5 wt %, but also include individual values and subranges within the indicated range. Thus, included in this numerical range are individual values such as 2, 3.5, and 4 and sub-ranges such as from 1-3, from 2-4, and from 3-5, etc. This same principle applies to ranges reciting a single numerical value. Furthermore, such an interpretation should apply regardless of the breadth of the range or the characteristics being described.

As used herein, unless specified otherwise, wt % values are to be taken as referring to a weight-for-weight (w/w) percentage of solids in the ink composition, and not including the weight of any carrier fluid present.

As used herein "infrared light", "infrared radiation", "IR light" or "IR radiation" refers to light having a wavelength in the range of about 700 nm to about 10000 nm, in some examples 750 nm to 10000 nm.

As used herein "visible light" or "visible radiation", for example the visible light emitted by a luminescent component, refers to light having a wavelength in the range of about 400 nm to about 700 nm.

The terms "light" and "radiation" can be used interchangeably.

As used herein "when viewed under visible light" refers to, for example, viewing the LEP ink composition or a LEP image through the human eye (e.g. unaided human eye) when the ambient light comprises mainly visible light, or essentially consists of visible light. For example, viewing under visible light may refer to viewing the LEP ink composition or LEP image in daylight or under an electric light (e.g. fluorescent lighting), therefore some IR light and/or UV light may be present. In some examples, viewing under visible light refers to viewing, e.g. the LEP ink composition or LEP image, through the human eye when the ambient light comprises mainly visible light, for example in the substantial absence of IR light, in some examples the intensity of any IR light present in the ambient light, and for example incident on the LEP ink composition or LEP image, is less than 1 $mW/mm^2$, for example less than 0.75 $mW/mm^2$, less than 0.5 $mW/mm^2$, less than 0.25 $mW/mm^2$, less than 0.1 $mW/mm^2$, or less than 0.05 $mW/mm^2$.

Unless otherwise stated, any feature described herein can be combined with any aspect or any other feature described herein.

In an aspect there is provided a security liquid electrophotographic (LEP) ink composition.

The security LEP ink composition may comprise:

a luminescent component;

a resin; and a carrier liquid, wherein the LEP ink composition is colourless when viewed under visible light and luminesces to emit visible light on exposure to IR light.

In an aspect there is provided a method of providing a security liquid electrophotographic (LEP) ink composition. The method may comprise:

providing a luminescent component which emits visible light on exposure to IR light; and combining the luminescent component with a resin and a carrier liquid to provide a LEP ink composition which is colourless when viewed under visible light.

In another aspect there is provided a method of printing a security LEP image. The method may comprise:

providing a LEP ink composition comprising:

a luminescent component which emits visible light on exposure to IR light;

a resin; and a carrier liquid; and liquid electrophotographically printing the LEP ink composition onto a print substrate to provide a security LEP image disposed on the print substrate, wherein the security LEP image is invisible to the human eye when viewed under visible light The present inventors have found that a LEP ink composition can be provided which is invisible to the human eye, for example transparent and colourless, when viewed under visible light, but emits visible light on exposure to infrared light so as to be useful in security applications.

Liquid Electrophotographic (LEP) Ink Composition

Described herein is a LEP ink composition comprising a luminescent component, a resin; and a carrier liquid for printing a security image.

The LEP ink composition described herein may be a security LEP ink composition, for example, a LEP ink composition which is, or a LEP ink composition which may be printed to form a LEP image which is, colourless when viewed under visible light and emits visible light on exposure to IR radiation. In some examples, the LEP ink composition or LEP image emits visible light on exposure to IR radiation having a wavelength in the range 700 nm to 1500 nm, for example 750 nm to 1500 nm, 800 to 1100 nm, or 940 nm to 1060 nm. In some examples, the LEP ink composition or LEP image emits visible light on exposure to IR radiation having a wavelength of about 980 nm. In some examples, the LEP image emits visible light on exposure to IR radiation having an intensity of 1 $mW/mm^2$ or greater, for example 2 $mW/mm^2$ or greater, 5 $mW/mm^2$ or greater, 10 $mW/mm^2$ or greater, 25 $mW/mm^2$ or greater, about 30 $mW/mm^2$ or greater, 50 $mW/mm^2$ or greater, 100 $mW/mm^2$ or greater, or 200 $mW/mm^2$ or greater. The LEP ink composition or a printed LEP image may be invisible to the human eye when viewed under visible light (for example, when viewed under natural daylight or electric lighting, such as fluorescent lighting), for example in the substantial absence of IR light. In some examples, the LEP ink composition or LEP image may be invisible to the human eye, when any IR light present in ambient light has an intensity of less than 1 $mW/mm^2$, for example less than 0.75 mW/mm$^2$, less than 0.5 mW/mm$^2$, less than 0.25 mW/mm$^2$, less than 0.1 mW/mm$^2$, or less than 0.05 mW/mm$^2$. In some examples, the LEP ink composition or LEP image may be invisible to the human eye when viewed under UV light. In some examples, the LEP ink composition or LEP image may be invisible to the human eye, when any IR light present has a wavelength of less than 750 nm or greater than 1500 nm, in some examples a wavelength of less than 800 nm or greater than 1100 nm, in some examples a wavelength less than 940 nm or greater than 1060 nm. In some examples, the LEP ink composition or LEP image may be invisible to the human eye when viewed under UV light. For example, the LEP ink composition or LEP printed image may be colourless, e.g. transparent and colourless, such that the human eye cannot see an image printed using the LEP ink composition. In some examples, a LEP image printed using the LEP ink composition is invisible to the human eye when printed on any print substrate described herein, for example paper, e.g. white paper, when viewed under visible light (for example natural daylight or electric lighting, such as fluorescent lighting). In some examples, the LEP ink composition is colourless and transparent such that a printed LEP image, for example a printed LEP image having a thickness of less than 10 μm, for example less than 5 μm, less than 4 μm, less than 3 μm, less than 2 μm, or less than 1 μm is invisible to the human eye when viewed under visible light, for example in the substantial absence of IR light.

As used herein "substantial absence of IR light" may refer to ambient light conditions in which any IR light present has an intensity of less than 1 mW/mm$^2$, for example less than 0.75 mW/mm$^2$, less than 0.5 mW/mm$^2$, less than 0.25 mW/mm$^2$, or less than 0.1 mW/mm$^2$, or less than 0.05 mW/mm$^2$.

As used herein "invisible to the human eye" may mean that a naked human eye (i.e. a human eye alone, e.g. unaided or in the absence of additional detection means) cannot see a LEP image printed using the LEP ink composition when viewed under visible light, for example in the substantial absence or absence of IR light. In some examples, a LEP image is invisible to the human eye if the eye cannot see a LEP image printed using the LEP ink composition on any print substrate, for example print substrates described herein, such as paper or white paper. In some examples, a LEP image is invisible to the human eye if the eye cannot see a LEP image printed the LEP ink composition on any print substrate such that the image has a thickness of 5 μm or less, for example 4 μm or less, 3 μm or less, 2 μm or less, or 1 μm or less. In some examples, a LEP image is invisible to the human eye if the image is transparent and colourless.

In some examples, a LEP image or LEP ink composition may be considered to be colourless if a printed LEP image does not substantially contribute a subtractive or additive effect on the colour of any print substrate (for example, where the colour of the print substrate is determined by the wavelength of light within the range of about 400 to about 700 nm reflected and/or emitted from the print substrate) on which the LEP image may be printed when viewed under visible light, for example in the absence or substantial absence of IR light. For example, a LEP image or LEP ink composition may not substantially contribute to a subtractive or additive effect on the colour of any print substrate as long as any visible light provided by the LEP image or LEP ink composition on exposure to visible light, or for example IR light having a wavelength below about 750 nm, or below about 800 nm, or IR light having a wavelength greater than about 1500 nm, or greater than about 1100 nm, or IR light having an intensity less than 1 mW/mm$^2$, for example less than 0.75 mW/mm$^2$, less than 0.5 mW/mm$^2$, less than 0.25 mW/mm$^2$, or less than 0.1 mW/mm$^2$, is not visible to (for example not detectable by) the human eye. For example, a LEP image or LEP ink composition may not substantially contribute to a subtractive or additive effect on the colour of any print substrate as long as any coloured visible light provided by the LEP image or LEP ink composition on exposure to visible light is of an intensity relative to ambient visible light such that any coloured visible light provided by the LEP image is of an intensity less than about 0.5% of the intensity of ambient light, for example less than about 0.1%, less than about 0.05%, less than about 0.01%, less than about 0.005%, less than about 0.001%, less than about 0.0005%, less than about 0.0001%, less than about 0.00005%, less than about 0.00001%, less than about 0.000005%, or less than about 0.000001% of the intensity of ambient light.

As used herein "coloured visible light provided by the LEP image of LEP ink composition" may refer to any visible light emitted by the LEP ink composition or LEP image on exposure to visible light or any absorption of visible light by the LEP image or LEP ink composition causing reflection of coloured visible light from the LEP image or the LEP ink composition. For example, if the LEP image or LEP ink composition absorbs visible light, the LEP image or LEP ink composition may only absorb visible light to an extent that reflected visible light from the LEP image or LEP ink composition having a different wavelength (coloured light) to ambient light (including visible light to which the image or ink is exposed and reflected and/or emitted visible light from the print substrate, or e.g. a receptacle in which the LEP ink composition may be held) has an intensity such that coloured light reflected by the LEP image or LEP ink composition, following absorption of visible light, cannot been seen by the human eye (for example the reflected coloured light has an intensity of less than about 0.5% of the intensity of ambient light, for example less than about 0.1%, less than about 0.05%, less than about 0.01%, less than about 0.005%, less than about 0.001%, less than about 0.0005%, less than about 0.0001%, less than about 0.00005%, less than about 0.00001%, less than about 0.000005%, or less than about 0.000001% of the intensity of ambient light).

For example, the LEP ink or a LEP image may be colourless, or transparent and colourless, for example colourless when viewed under visible light. In some examples, a colourless LEP ink composition or a LEP image which does not absorb or emit visible light (i.e. light having a wavelength of about 400 to about 700 nm). A colourless LEP ink composition may be one that is free from pigment. A colourless LEP ink composition or LEP image may be one that does not contribute a subtractive effect on the colour of any print substrate on which the security LEP ink composition may be printed. A colourless and transparent LEP ink composition, or LEP image, may be invisible to the human eye when viewed under visible light.

The LEP ink composition or LEP image may be transparent. A LEP ink composition or LEP image may be considered to be transparent if the LEP ink composition or LEP image allows substantially all visible light incident on the LEP ink composition or LEP image to be transmitted through the LEP image or LEP ink composition. A LEP ink composition or LEP image may be considered to be transparent if the LEP ink composition or LEP image allows at least about 60%, for example at least about 70%, at least about 80%, at least about 90%, at least about 95%, at least about 98%, at least about 99%, at least about 99.5%, at least about 99.95%, or at least about 99.99% of visible light incident on the LEP image or LEP ink composition to be transmitted through the LEP image or LEP ink composition.

In some examples the LEP ink composition may comprise a plurality of luminescent components, for example a first luminescent component and a second luminescent component. In some examples each of the plurality of luminescent components may emit visible light of a different wavelength (i.e. different colour) to each of the other of the plurality of luminescent components, for example the LEP ink composition may comprise a first luminescent component and a second luminescent component wherein the first luminescent component emits visible light having a first wavelength and the second luminescent component emits visible light having a second wavelength on exposure to IR light. In some examples the first wavelength and the second wavelength are different. In some examples, the first luminescent component and the second luminescent component emit visible light of different colours on exposure to the same IR light source. A LEP ink composition, or a LEP image printed therefrom, comprising a first luminescent component and a second luminescent component may emit visible light having the combined emission spectrum of the first and second luminescent component on exposure to IR light. Each of the first and second, or plurality, of luminescent components may be independently selected from the luminescent components described below.

Luminescent Component

The liquid electrophotographic (LEP) ink, e.g. security ink, comprises a luminescent component.

A "luminescent component" as described herein is a component that absorbs IR radiation and emits visible light, for example a component that undergoes anti-Stokes emission on exposure to IR light to emit visible light. The visible light emitted by the luminescent component may be visible to the human eye. The luminescent component up converts IR light to light having a visible wavelength. Without wishing to be bound by theory, it is thought that the luminescent component undergoes multiphoton absorption following exposure to IR light, for example IR laser light, which excites electrons, the excited electrons then relax through fluorescence to the ground state while emitting visible light. In some examples, a luminescent component as described herein is a component for which the average lifetime of the excited atoms or molecules on absorption of IR light is less than about $10^{-4}$ seconds, for example less than about $10^{-8}$ seconds. The IR light to which the LEP ink composition or LEP image is exposed in order to cause emission of visible light may be IR light having a wavelength in the range about 700 nm to about 1500 nm, for example about 750 nm to about 1500 nm, or about 800 nm to about 1100 nm. In some examples, the IR light to which the LEP ink composition or LEP image is exposed in order to cause emission of visible light may be IR light having a peak wavelength of about 980 nm. In some examples, the IR light to which the LEP ink composition or LEP image is exposed in order to cause visible light emission may have an intensity of about 1 mW/mm$^2$ or greater, for example about 2 mW/mm$^2$ or greater, about 5 mW/mm$^2$ or greater, about 10 mW/mm$^2$ or greater, about 25 mW/mm$^2$ or greater, about 30 mW/mm$^2$ or greater, about 50 mW/mm$^2$ or greater, or about 100 mW/mm$^2$ or greater. In some examples, the IR light to which the LEP ink composition or LEP image is exposed in order to cause visible light emission may have an intensity of about 200 mW/mm$^2$ or greater. In some examples, the luminescent component emits visible light on exposure to IR light having a wavelength in the range about 700 nm to about 1500 nm, for example about 750 nm to about 1500 nm, about 800 nm to about 1100 nm, or a peak wavelength of about 980 nm and/or an intensity of about 1 mW/mm$^2$ or greater, for example about 2 mW/mm$^2$ or greater, about 5 mW/mm$^2$ or greater, about 10 mW/mm$^2$ or greater, about 25 mW/mm$^2$ or greater, about 30 mW/mm$^2$ or greater, about 50 mW/mm$^2$ or greater, about 100 mW/mm$^2$ or greater, or about 200 mW/mm$^2$ or greater.

In some examples, the luminescent component may have an excitation wavelength in the range of about 700 nm to about 1500 nm, for example about 750 nm to about 1500 nm, about 800 nm to about 1100 nm, or an excitation wavelength of about 980 nm. The term "excitation wavelength" as used herein refers to the wavelength or range of wavelengths of radiation absorbed by the luminescent component to cause emission of visible light.

The luminescent component emits visible light on exposure to IR light. In some examples the luminescent component emits visible light on exposure to IR light having a wavelength in the range about 700 nm to about 1500 nm, for example about 750 nm to about 1500 nm, about 800 nm to about 1100 nm, or of about 980 nm. In some examples, the luminescent component emits visible light on exposure to IR light having an intensity above a threshold value. In some examples, luminescent component emits visible light on exposure to IR light having an intensity of about 1 mW/mm$^2$ or greater, for example about 2 mW/mm$^2$ or greater, about 5 mW/mm$^2$ or greater, about 10 mW/mm$^2$ or greater, about 25 mW/mm$^2$ or greater, about 30 mW/mm$^2$ or greater, about 50 mW/mm$^2$ or greater, about 100 mW/mm$^2$ or greater, or about 200 mW/mm$^2$ or greater.

In some examples, the luminescent component may comprise, consist essentially of, or consist of materials containing d-block elements (i.e. elements from groups 3-12 of the periodic table) and/or f-block elements (i.e. lanthanides and actinides), for example nickel, molybdenum, osmium, titanium, rhenium, copper, chromium, ruthenium, palladium, iridium, platinum, gold or lanthanide containing materials. In some examples, the luminescent component may comprise, consist essentially of, or consist of transition metal or rare-earth containing materials. In some examples, the materials containing d-block or f-block elements (e.g. transition metal or rare-earth containing materials) may comprise transition metal or rare-earth containing complexes or inorganic compounds. In some examples, the transition metal containing materials may be selected from complexes of transition metals, for example transition metal complexes selected from the group comprising Cu(I), Cu(II), Cr(III), Re(I), Re(III), Ru(II), Os(II), Ir(III), Pt(II), Pd(II), Au(I), and Au(III) complexes. In some examples the transition metal containing materials may comprise, essentially consist of or consist of transition metal oxysulfides, oxides, hydroxides, hydrides, halides and combinations thereof. In some examples the rare-earth containing materials may comprise, essentially consist of or consist of rare-earth oxysulfides, oxides, hydroxides, hydrides, halides and combinations thereof. In some examples the rare-earth containing materials may comprise, essentially consist of or consist of lanthanide oxysulfides, lanthanide oxides, lanthanide hydroxides, lanthanide hydrides, lanthanide halides and combinations thereof. In some examples, the luminescent component may comprise, consist essentially of, or consist of transition metal complexes, rare-earth complexes, rare-earth oxysulfides, rare-earth oxides, rare-earth hydroxides, rare-earth hydrides, rare-earth halides, or combinations thereof. In some examples, the luminescent component may comprise, consist essentially of, or consist of transition metal complexes selected from the group comprising Cu(I), Cu(II), Cr(III), Re(I), Re(III), Ru(II), Os(II), Ir(III), Pt(II), Pd(II), Au(I), and Au(III) complexes, lanthanide complexes, lanthanide oxysulfides, lanthanide oxides, lanthanide hydroxides, lanthanide hydrides, lanthanide halides, or combinations thereof. The inventors have found that such luminescent components undergo IR upconversion to emit visible light and also show excellent light fastness, chemical stability and mechanical durability.

The luminescent component may be selected to emit visible light having a particular wavelength, i.e. a particular colour.

In some example, the luminescent component may be selected from LLRS1(Red) and LLRS3 (Green) (available from VerifyMe) and LUUPC1(Red), LUUPC2(Green) and LUUPC3(Blue) (available from Luinochem).

The luminescent component may be present in the LEP ink composition, for example the total luminescent component content of the LEP ink composition, in an amount of from 10 wt % to 80 wt % of the total amount of solids in the LEP ink composition, in some examples 15 wt % to 80 wt %, in some examples 15 wt % to 60 wt %, in some examples 15 wt % to 50 wt %, in some examples 20 wt % to 45 wt %, in some examples 25 wt % to 45 wt %, in some examples 25 wt % to 40 wt % of the total amount of solids in the LEP ink composition.

Resin

The electrostatic ink composition includes a resin, which may be a thermoplastic resin. A thermoplastic polymer is sometimes referred to as a thermoplastic resin. The resin may coat the luminescent component. In some examples, the resin coats the luminescent component such that particles are formed having a core of luminescent component and an outer layer of resin thereon. The outer layer of resin may coat the luminescent component partially or completely.

In some examples, the electrostatic ink composition may comprise ink particles comprising a luminescent component and a resin.

The resin may include a polymer. In some examples, the polymer of the resin may be selected from ethylene acrylic acid copolymers; ethylene methacrylic acid copolymers; ethylene vinyl acetate copolymers; copolymers of ethylene (e.g. 80 wt % to 99.9 wt %) and alkyl (e.g. C1 to C5) ester of methacrylic or acrylic acid (e.g. 0.1 wt % to 20 wt %); copolymers of ethylene (e.g. 80 wt % to 99.9 wt %), acrylic or methacrylic acid (e.g. 0.1 wt % to 20.0 wt %) and alkyl (e.g. C1 to C5) ester of methacrylic or acrylic acid (e.g. 0.1 wt % to 20 wt %); polyethylene; polystyrene; isotactic polypropylene (crystalline); ethylene ethyl acrylate; polyesters; polyvinyl toluene; polyamides; styrene/butadiene copolymers; epoxy resins; acrylic resins (e.g. copolymer of acrylic or methacrylic acid and at least one alkyl ester of acrylic or methacrylic acid wherein alkyl is, in some examples, from 1 to about 20 carbon atoms, such as methyl methacrylate (e.g. 50 wt % to 90 wt %)/methacrylic acid (e.g. 0 wt % to 20 wt %)/ethylhexylacrylate (e.g. 10 wt % to 50 wt %)); ethylene-acrylate terpolymers:ethylene-acrylic esters-maleic anhydride (MAH) or glycidyl methacrylate (GMA) terpolymers; ethylene-acrylic acid ionomers and combinations thereof.

In some examples, the polymer is a copolymer of an alkylene monomer and a monomer having an acid side group. In some examples the alkylene monomer is an ethylene or a propylene monomer. In some examples, the monomer having an acid side group is an acrylic acid monomer or a methacrylic acid monomer. In some examples, the electrostatic ink composition comprises a polymer resin comprising a copolymer of an alkylene monomer and a monomer selected from acrylic acid and methacrylic acid.

The resin may comprise a polymer having acidic side groups. The polymer having acidic side groups may have an acidity of 50 mg KOH/g or more, in some examples an acidity of 60 mg KOH/g or more, in some examples an acidity of 70 mg KOH/g or more, in some examples an acidity of 80 mg KOH/g or more, in some examples an acidity of 90 mg KOH/g or more, in some examples an acidity of 100 mg KOH/g or more, in some examples an acidity of 105 mg KOH/g or more, in some examples 110 mg KOH/g or more, in some examples 115 mg KOH/g or more. The polymer having acidic side groups may have an acidity of 200 mg KOH/g or less, in some examples 190 mg or less, in some examples 180 mg or less, in some examples 130 mg KOH/g or less, in some examples 120 mg KOH/g or less. Acidity of a polymer, as measured in mg KOH/g can be measured using standard procedures, for example using the procedure described in ASTM D1386.

The resin may comprise a polymer, in some examples a polymer having acidic side groups, that has a melt flow rate of less than about 60 g/10 minutes, in some examples about 50 g/10 minutes or less, in some examples about 40 g/10 minutes or less, in some examples 30 g/10 minutes or less, in some examples 20 g/10 minutes or less, in some examples 10 g/10 minutes or less. In some examples, all polymers having acidic side groups and/or ester groups in the particles each individually have a melt flow rate of less than 90 g/10 minutes, 80 g/10 minutes or less, in some examples 80 g/10 minutes or less, in some examples 70 g/10 minutes or less, in some examples 60 g/10 minutes or less.

The polymer having acidic side groups can have a melt flow rate of about 10 g/10 minutes to about 120 g/10 minutes, in some examples about 10 g/10 minutes to about 70 g/10 minutes, in some examples about 10 g/10 minutes to 40 g/10 minutes, in some examples 20 g/10 minutes to 30 g/10 minutes. The polymer having acidic side groups can have a melt flow rate of in some examples about 50 g/10 minutes to about 120 g/10 minutes, in some examples 60 g/10 minutes to about 100 g/10 minutes.

In some examples, the polymer having acid side groups has a melt flow rate of greater than about 120 g/10 minutes, in some examples greater than about 200 g/10 minutes, in some examples greater than about 300 g/10 minutes, in some examples greater than about 400 g/10 minutes. In some examples, the polymer having acid side groups has a melt flow rate of about 450 g/10 minutes.

In some examples, the polymer having acid side groups has a melt flow rate of less than about 500 g/10 minutes.

In some examples, the polymer having acid side groups has a melt flow rate in the range of about 150 g/10 minutes to about 600 g/10 minutes. In some examples, the polymer having acid side groups has a melt flow rate in the range of about 200 g/10 minutes to about 500 g/10 minutes.

In some examples, the polymer having acid side groups constitutes at least 50 wt. % of the resin, in some examples at least 60 wt. % in some examples at least 80 wt. %, in some examples at least 90 wt. %. In some examples, the polymer having acid side groups has a melt flow rate of greater than about 200 g/10 minutes, in some examples a melt flow rate of greater than about 200 g/10 minutes and up to about 500 g/10 minutes, and constitutes at least 50 wt. % of the resin, in some examples at least 60 wt. % in some examples at least 80 wt. %, in some examples at least 90 wt. %.

The melt flow rate can be measured using standard procedures, for example as described in ASTM D1238.

The acidic side groups may be in free acid form or may be in the form of an anion and associated with one or more counterions, generally metal counterions, e.g. a metal selected from the alkali metals, such as lithium, sodium and potassium, alkali earth metals, such as magnesium or calcium, and transition metals, such as zinc. The polymer having acidic side groups can be selected from resins such as copolymers of ethylene and an ethylenically unsaturated acid of either acrylic acid or methacrylic acid; and ionomers thereof, such as methacrylic acid and ethylene-acrylic or methacrylic acid copolymers which are at least partially neutralized with metal ions (e.g. Zn, Na, Li) such as SURLYN® ionomers. The polymer comprising acidic side groups can be a copolymer of ethylene and an ethylenically unsaturated acid of either acrylic or methacrylic acid, where the ethylenically unsaturated acid of either acrylic or methacrylic acid constitute from 5 wt % to about 25 wt % of the copolymer, in some examples from 10 wt % to about 20 wt % of the copolymer.

The resin may comprise two different polymers having acidic side groups. The two polymers having acidic side groups may have different acidities, which may fall within the ranges mentioned above. The resin may comprise a first polymer having acidic side groups that has an acidity of from 50 mg KOH/g to 110 mg KOH/g and a second polymer having acidic side groups that has an acidity of 110 mg KOH/g to 130 mg KOH/g.

The resin may comprise two different polymers having acidic side groups: a first polymer having acidic side groups that has a melt flow rate of about 10 g/10 minutes to about 50 g/10 minutes and an acidity of from 50 mg KOH/g to 110 mg KOH/g, and a second polymer having acidic side groups that has a melt flow rate of about 50 g/10 minutes to about 120 g/10 minutes and an acidity of 110 mg KOH/g to 130 mg KOH/g. The first and second polymers may be absent of ester groups.

The resin may comprise two different polymers having acidic side groups: a first polymer that is a copolymer of ethylene (e.g. 92 to 85 wt %, in some examples about 89 wt %) and acrylic or methacrylic acid (e.g. 8 to 15 wt %, in some examples about 11 wt %) having a melt flow rate of 80 to 110 g/10 minutes and a second polymer that is a copolymer of ethylene (e.g. about 80 to 92 wt %, in some examples about 85 wt %) and acrylic acid (e.g. about 18 to 12 wt %, in some examples about 15 wt %), having a melt viscosity lower than that of the first polymer, the second polymer for example having a melt viscosity of 15000 poise or less, in some examples a melt viscosity of 10000 poise or less, in some examples 1000 poise or less, in some examples 100 poise or less, in some examples 50 poise or less, in some examples 10 poise or less. Melt viscosity can be measured using standard techniques. The melt viscosity can be measured using a rheometer, e.g. a commercially available AR-2000 Rheometer from Thermal Analysis Instruments, using the geometry of: 25 mm steel plate-standard steel parallel plate, and finding the plate over plate rheometry isotherm at 120° C., 0.01 hz shear rate.

In any of the resins mentioned above, the ratio of the first polymer having acidic side groups to the second polymer having acidic side groups can be from about 10:1 to about 2:1. In another example, the ratio can be from about 6:1 to about 3:1, in some examples about 4:1.

The resin may comprise a polymer having a melt viscosity of 15000 poise or less, in some examples a melt viscosity of 10000 poise or less, in some examples 1000 poise or less, in some examples 100 poise or less, in some examples 50 poise or less, in some examples 10 poise or less; said polymer may be a polymer having acidic side groups as described herein. The resin may comprise a first polymer having a melt viscosity of 15000 poise or more, in some examples 20000 poise or more, in some examples 50000 poise or more, in some examples 70000 poise or more; and in some examples, the resin may comprise a second polymer having a melt viscosity less than the first polymer, in some examples a melt viscosity of 15000 poise or less, in some examples a melt viscosity of 10000 poise or less, in some examples 1000 poise or less, in some examples 100 poise or less, in some examples 50 poise or less, in some examples 10 poise or less. The resin may comprise a first polymer having a melt viscosity of more than 60000 poise, in some examples from 60000 poise to 100000 poise, in some examples from 65000 poise to 85000 poise; a second polymer having a melt viscosity of from 15000 poise to 40000 poise, in some examples 20000 poise to 30000 poise, and a third polymer having a melt viscosity of 15000 poise or less, in some examples a melt viscosity of 10000 poise or less, in some examples 1000 poise or less, in some examples 100 poise or less, in some examples 50 poise or less, in some examples 10 poise or less; an example of the first polymer is NUCREL® 960 (from DuPont), and an example of the second polymer is NUCREL® 699 (from DuPont), and an example of the third polymer is AC-5120 (from Honeywell). The first, second and third polymers may be polymers having acidic side groups as described herein. The melt viscosity can be measured using a rheometer, e.g. a commercially available AR-2000 Rheometer from Thermal Analysis Instruments, using the geometry of: 25 mm steel plate-standard steel parallel plate, and finding the plate over plate rheometry isotherm at 120° C., 0.01 hz shear rate.

If the resin comprises a single type of resin polymer, the resin polymer (excluding any other components of the electrostatic ink composition) may have a melt viscosity of 6000 poise or more, in some examples a melt viscosity of 8000 poise or more, in some examples a melt viscosity of 10000 poise or more, in some examples a melt viscosity of 12000 poise or more. If the resin comprises a plurality of polymers all the polymers of the resin may together form a mixture (excluding any other components of the electrostatic ink composition) that has a melt viscosity of 6000 poise or more, in some examples a melt viscosity of 8000 poise or more, in some examples a melt viscosity of 10000 poise or more, in some examples a melt viscosity of 12000 poise or more. Melt viscosity can be measured using standard techniques. The melt viscosity can be measured using a rheometer, e.g. a commercially available AR-2000 Rheometer from Thermal Analysis Instruments, using the geometry of: 25 mm steel plate-standard steel parallel plate, and finding the plate over plate rheometry isotherm at 120° C., 0.01 hz shear rate.

The resin may comprise two different polymers having acidic side groups that are selected from copolymers of ethylene and an ethylenically unsaturated acid of either methacrylic acid or acrylic acid; and ionomers thereof, such as methacrylic acid and ethylene-acrylic or methacrylic acid copolymers which are at least partially neutralized with metal ions (e.g. Zn, Na, Li) such as SURLYN® ionomers. The resin may comprise (i) a first polymer that is a copolymer of ethylene and an ethylenically unsaturated acid of either acrylic acid or methacrylic acid, wherein the ethylenically unsaturated acid of either acrylic or methacrylic acid constitutes from about 8 wt % to about 16 wt % of the copolymer, in some examples about 10 wt % to about 16 wt % of the copolymer; and (ii) a second polymer that is a copolymer of ethylene and an ethylenically unsaturated acid of either acrylic acid and methacrylic acid, wherein the ethylenically unsaturated acid of either acrylic or methacrylic acid constitutes from about 12 wt % to about 30 wt % of the copolymer, in some examples from about 14 wt % to about 20 wt % of the copolymer, in some examples from about 16 wt % to about 20 wt % of the copolymer in some examples from about 17 wt % to about 19 wt % of the copolymer.

In some examples, the resin essentially consists of a copolymer of ethylene and methacrylic acid. In some examples the methacrylic acid of the copolymer of ethylene and methacrylic acid constitutes about 8 wt % to about 12 wt % of the copolymer, in some examples about 9 wt % to about 11 wt % of the copolymer, in some examples about 10 wt. % of the copolymer.

In an example, the resin constitutes about 5 to about 90%, in some examples about 5 to about 80%, by weight of the solids of the electrostatic ink composition. In another example, the resin constitutes about 10 to about 60% by weight of the solids of the electrostatic ink composition. In another example, the resin constitutes about 15 to about 40% by weight of the solids of the electrostatic ink composition. In another example, the resin constitutes about 60 to about 95% by weight, in some examples from about 80 to about 90% by weight, of the solids of the electrostatic ink composition.

The resin may comprise a polymer having acidic side groups, as described above (which may be free of ester side groups), and a polymer having ester side groups. The polymer having ester side groups is, in some examples, a thermoplastic polymer. The polymer having ester side groups may further comprise acidic side groups. The polymer having ester side groups may be a co-polymer of a monomer having ester side groups and a monomer having acidic side groups. The polymer may be a co-polymer of a monomer having ester side groups, a monomer having acidic side groups, and a monomer absent of any acidic and ester side groups. The monomer having ester side groups may be a monomer selected from esterified acrylic acid or esterified methacrylic acid. The monomer having acidic side groups may be a monomer selected from acrylic or methacrylic acid. The monomer absent of any acidic and ester side groups may be an alkylene monomer, including, for example, ethylene or propylene. The esterified acrylic acid or esterified methacrylic acid may, respectively, be an alkyl ester of acrylic acid or an alkyl ester of methacrylic acid. The alkyl group in the alkyl ester of acrylic or methacrylic acid may be an alkyl group having 1 to 30 carbons, in some examples 1 to 20 carbons, in some examples 1 to 10 carbons; in some examples selected from methyl, ethyl, iso-propyl, n-propyl, t-butyl, iso-butyl, n-butyl and pentyl.

The polymer having ester side groups may be a co-polymer of a first monomer having ester side groups, a second monomer having acidic side groups and a third monomer which is an alkylene monomer absent of any acidic and ester side groups. The polymer having ester side groups may be a co-polymer of (i) a first monomer having ester side groups selected from esterified acrylic acid or esterified methacrylic acid, in some examples an alkyl ester of acrylic or methacrylic acid, (ii) a second monomer having acidic side groups selected from acrylic or methacrylic acid and (iii) a third monomer which is an alkylene monomer selected from ethylene and propylene. The first monomer may constitute about 1 to about 50% by weight of the co-polymer, in some examples about 5 to about 40% by weight, in some examples 5 about to about 20% by weight of the copolymer, in some examples about 5 to about 15% by weight of the copolymer. The second monomer may constitute about 1 to about 50% by weight of the co-polymer, in some examples about 5 to about 40% by weight of the co-polymer, in some examples about 5 to about 20% by weight of the co-polymer, in some examples about 5 to about 15% by weight of the copolymer. In an example, the first monomer constitutes about 5 to about 40% by weight of the co-polymer, the second monomer constitutes about 5 to about 40% by weight of the co-polymer, and with the third monomer constituting the remaining weight of the copolymer. In an example, the first monomer constitutes about 5 to about 15% by weight of the co-polymer, the second monomer constitutes about 5 to about 15% by weight of the co-polymer, with the third monomer constituting the remaining weight of the copolymer. In an example, the first monomer constitutes about 8 to about 12% by weight of the co-polymer, the second monomer constitutes about 8 to about 12% by weight of the co-polymer, with the third monomer constituting the remaining weight of the copolymer. In an example, the first monomer constitutes about 10% by weight of the co-polymer, the second monomer constitutes about 10% by weight of the co-polymer, and with the third monomer constituting the remaining weight of the copolymer. The polymer having ester side groups may be selected from the BYNEL® class of monomer, including BYNEL® 2022 and BYNEL® 2002, which are available from DuPont®.

The polymer having ester side groups may constitute about 1% or more by weight of the total amount of the resin polymers in the resin, e.g. the total amount of the polymer or polymers having acidic side groups and polymer having ester side groups. The polymer having ester side groups may constitute about 5% or more by weight of the total amount of the resin polymers in the resin, in some examples about 8% or more by weight of the total amount of the resin polymers in the resin, in some examples about 10% or more by weight of the total amount of the resin polymers in the resin, in some examples about 15% or more by weight of the total amount of the resin polymers in the resin, in some examples about 20% or more by weight of the total amount of the resin polymers in the resin, in some examples about 25% or more by weight of the total amount of the resin polymers in the resin, in some examples about 30% or more by weight of the total amount of the resin polymers in the resin, in some examples about 35% or more by weight of the total amount of the resin polymers in the resin. The polymer having ester side groups may constitute from about 5% to about 50% by weight of the total amount of the resin polymers in the resin, in some examples about 10% to about 40% by weight of the total amount of the resin polymers in the resin, in some examples about 15% to about 30% by weight of the total amount of the polymers in the resin.

The polymer having ester side groups may have an acidity of 50 mg KOH/g or more, in some examples an acidity of about 60 mg KOH/g or more, in some examples an acidity of about 70 mg KOH/g or more, in some examples an acidity of about 80 mg KOH/g or more. The polymer having ester side groups may have an acidity of about 100 mg KOH/g or less, in some examples about 90 mg KOH/g or less. The polymer having ester side groups may have an acidity of about 60 mg KOH/g to about 90 mg KOH/g, in some examples about 70 mg KOH/g to about 80 mg KOH/g.

The polymer having ester side groups may have a melt flow rate of about 10 g/10 minutes to about 120 g/10 minutes, in some examples about 10 g/10 minutes to about 50 g/10 minutes, in some examples about 20 g/10 minutes to about 40 g/10 minutes, in some examples about 25 g/10 minutes to about 35 g/10 minutes.

In an example, the polymer or polymers of the resin can be selected from the NUCREL family of resins (e.g. NUCREL® 403, NUCREL® 407, NUCREL® 609HS, NUCREL® 908HS, NUCREL® 1202HC, NUCREL® 30707, NUCREL® 1214, NUCREL® 903, NUCREL® 3990, NUCREL® 910, NUCREL® 925, NUCREL® 699, NUCREL® 599, NUCREL® 960, NUCREL® RX 76, NUCREL® 2806, BYNEL® 2002, BYNEL®2014, and BYNEL® 2020 (sold by E. I. du PONT)), the ACLYN® family of resins (e.g. ACLYN® 201, ACLYN® 246, ACLYN® 285, and ACLYN® 295), and the LOTADER® family of resins (e.g. LOTADER® 2210, LOTADER® 3430, and LOTADER® 8200 (sold by Arkema)).

In some examples, the luminescent component constitutes a certain wt %, e.g. from about 1 wt %, to about 60 wt %, in some examples from about 20 wt. % to about 50 wt. %, of the solids of the electrostatic ink composition, and the remaining wt % of the solids of the electrostatic ink composition is formed by the resin and, in some examples, any other additives that are present. The other additives may constitute about 10 wt % or less of the solids of the electrostatic ink composition, in some examples about 5 wt % or less of the solids of the electrostatic ink composition, in some examples about 3 wt % or less of the solids of the electrostatic ink composition. In some examples, the resin may constitute about 5% to about 99% by weight of the solids in the electrostatic ink composition, in some examples about 50% to about 90% by weight of the solids of the electrostatic ink composition, in some examples about 70% to about 90% by weight of the solids of the electrostatic ink composition. The remaining wt % of the solids in the ink composition may be a luminescent component, in some examples, any other additives that may be present.

Carrier Liquid

The LEP ink composition includes a liquid carrier. In some examples, the LEP ink composition comprises ink particles including the resin which may be dispersed in the liquid carrier. The liquid carrier can include or be a hydrocarbon, silicone oil, vegetable oil, etc. The liquid carrier can include, for example, an insulating, non-polar, non-aqueous liquid that can be used as a medium for ink particles, i.e. the ink particles including the resin and, in some examples, a luminescent component. The liquid carrier can include compounds that have a resistivity in excess of about $10^9$ ohm·cm. The liquid carrier may have a dielectric constant below about 5, in some examples below about 3. The liquid carrier can include hydrocarbons. The hydrocarbon can include, for example, aliphatic hydrocarbons, isomerized aliphatic hydrocarbons, branched chain aliphatic hydrocarbons, aromatic hydrocarbons, and combinations thereof. Examples of the liquid carriers include, for example, aliphatic hydrocarbons, isoparaffinic compounds, paraffinic compounds, dearomatized hydrocarbon compounds, and the like. In particular, the liquid carriers can include, for example, ISOPAR™ G, ISOPAR™ H, ISOPAR™ L, ISOPAR™ M, ISOPAR™ K, ISOPAR™ V, NORPAR® 12, NORPAR® 13, NORPAR® 15, EXXSOL™ D40, EXXSOL™ D80, EXXSOL™ D100, EXXSOL™ D130, EXXSOL™ D140 (each sold by EXXON CORPORATION); TECLEN™ N-16, TECLEN™ N-20, TECLEN™ N-22, NISSEKI NAPHTHESOL™ L, NISSEKI NAPHTHESOL™ M, NISSEKI NAPHTHESOL™ H, #0 SOLVENT™ L, #0 SOLVENT™ M, #0 SOLVENT™ H, NISSEKI ISOSOL™ 300, NISSEKI ISOSOL™ 400, AF-4™, AF-5™, AF-6™ and AF-7™ (each sold by NIPPON OIL CORPORATION); IP SOLVENT™ 1620 and IP SOLVENT™ 2028 (each sold by IDEMITSU PETROCHEMICAL CO., LTD.); AMSCO™ OMS and AMSCO™ 460 (each sold by AMERICAN MINERAL SPIRITS CORP.); and Electron, Positron, New II, Purogen HF (100% synthetic terpenes) (sold by ECOLINK™).

The liquid carrier can constitute about 20% to about 99.5% by weight of the LEP ink composition, in some examples about 50% to about 99.5% by weight of the LEP ink composition. The liquid carrier may constitute about 40 to about 90% by weight of the LEP ink composition. The liquid carrier may constitute about 60% to about 80% by weight of the LEP ink composition. The liquid carrier may constitute about 90% to about 99.5% by weight of the LEP ink composition, in some examples about 95% to about 99% by weight of the LEP ink composition.

The liquid electrostatic ink composition, when printed on a print substrate, may be substantially free from liquid carrier. In an electrostatic printing process and/or afterwards, the liquid carrier may be removed, e.g. by an electrophoresis processes during printing and/or evaporation, such that substantially just solids are transferred to the print substrate. Substantially free from liquid carrier may indicate that the ink printed on the print substrate contains less than about 5 wt % liquid carrier, in some examples, less than about 2 wt % liquid carrier, in some examples less than about 1 wt % liquid carrier, in some examples less than about 0.5 wt % liquid carrier. In some examples, the ink printed on the print substrate is free from liquid carrier.

Charge Director

In some examples, the LEP ink composition includes a charge director. The charge director may be added to a LEP ink composition in order to impart and/or maintain sufficient electrostatic charge on the ink particles. In some examples, the charge director may comprise ionic compounds, particularly metal salts of fatty acids, metal salts of sulfo-succinates, metal salts of oxyphosphates, metal salts of alkylbenzenesulfonic acid, metal salts of aromatic carboxylic acids or sulfonic acids, as well as zwitterionic and non-ionic compounds, such as polyoxyethylated alkylamines, lecithin, polyvinylpyrrolidone, organic acid esters of polyvalent alcohols, etc. The charge director can be selected from, for example, oil-soluble petroleum sulfonates (e.g. neutral Calcium PETRONATE™, neutral Barium PETRONATE™, and basic Barium PETRONATE™), polybutylene succinim ides (e.g. OLOA™ 1200 and AMOCO 575), and glyceride salts (e.g. sodium salts of phosphated mono- and diglycerides with unsaturated and saturated acid substituents), sulfonic acid salts including, for example, barium, sodium, calcium, and aluminium salts of sulfonic acid. The sulfonic acids may include, for example, alkyl sulfonic acids, aryl sulfonic acids, and sulfonic acids of alkyl succinates. The charge director can impart a negative charge or a positive charge on the resin-containing particles of a LEP ink composition.

The charge director may be added in order to impart and/or maintain sufficient electrostatic charge on the ink particles, which may be particles comprising the thermoplastic resin.

In some examples, the LEP ink composition comprises a charge director comprising a simple salt. The ions constructing the simple salts are all hydrophilic. The simple salt may include a cation selected from the group consisting of Mg, Ca, Ba, $NH_4$, tert-butyl ammonium, $Li^+$, and $Al^{+3}$, or from any sub-group thereof. The simple salt may include an anion selected from the group consisting of $SO_4^{2-}$, $PO^{3-}$, $NO^{3-}$, $HPO_4^{2-}$, $CO_3^{2-}$, acetate, trifluoroacetate (TFA), $Cl^-$, $BF_4^-$, $F^-$, $ClO_4^-$, and $TiO_3^{4-}$ or from any sub-group thereof. The simple salt may be selected from $CaCO_3$, $Ba_2TiO_3$, $Al_2(SO_4)$, $Al(NO_3)_3$, $Ca_3(PO_4)_2$, $BaSO_4$, $BaHPO_4$, $Ba_2(PO_4)_3$, $CaSO_4$, $(NH_4)_2CO_3$, $(NH_4)_2SO_4$, $NH_4OAc$, tert-butyl ammonium bromide, $NH_4NO_3$, LiTFA, $Al_2(SO_4)_3$, $LiClO_4$ and $LiBF_4$, or any sub-group thereof.

In some examples, the LEP ink composition comprises a charge director comprising a sulfosuccinate salt of the general formula $MA_n$, wherein M is a metal, n is the valence of M, and A is an ion of the general formula (I): $[R^1—O—C(O)CH_2CH(SO_3^-)C(O)—O—R^2]$, wherein each of $R^1$ and $R^2$ is an alkyl group. In some examples each of $R^1$ and $R^2$ is an aliphatic alkyl group. In some examples, each of $R^1$ and $R^2$ independently is a C6-25 alkyl. In some examples, said aliphatic alkyl group is linear. In some examples, said aliphatic alkyl group is branched. In some examples, said aliphatic alkyl group includes a linear chain of more than 6 carbon atoms. In some examples, $R^1$ and $R^2$ are the same. In some examples, at least one of $R^1$ and $R^2$ is $C_{13}H_{27}$. In some examples, M is Na, K, Cs, Ca, or Ba.

In some examples, the charge director comprises at least one micelle forming salt and nanoparticles of a simple salt as described above. The simple salts are salts that do not form micelles by themselves, although they may form a core for micelles with a micelle forming salt. The sulfosuccinate salt of the general formula $MA_n$ is an example of a micelle forming salt. The charge director may be substantially free of an acid of the general formula HA, where A is as described above. The charge director may include micelles of said sulfosuccinate salt enclosing at least some of the nanoparticles of the simple salt. The charge director may include at least some nanoparticles of the simple salt having a size of 200 nm or less, and/or in some examples 2 nm or more.

The charge director may include one of, some of or all of (i) soya lecithin, (ii) a barium sulfonate salt, such as basic barium petronate (BPP), and (iii) an isopropyl amine sulfonate salt. Basic barium petronate is a barium sulfonate salt of a 21-26 hydrocarbon alkyl, and can be obtained, for example, from Chemtura. An example isopropyl amine sulphonate salt is dodecyl benzene sulfonic acid isopropyl amine, which is available from Croda.

In some examples, the charge director constitutes about 0.001% to about 20%, in some examples about 0.01% to about 20% by weight, in some examples about 0.01 to about 10% by weight, in some examples about 0.01% to about 1% by weight of the solids of a LEP ink composition. In some examples, the charge director constitutes about 0.001% to about 0.15% by weight of the solids of the LEP ink composition, in some examples about 0.001% to about 0.15%, in some examples about 0.001% to about 0.02% by weight of the solids of a LEP ink composition, in some examples about 0.1% to about 2% by weight of the solids of the LEP ink composition, in some examples about 0.2% to about 1.5% by weight of the solids of the LEP ink composition in some examples about 0.1% to about 1% by weight of the solids of the LEP ink composition, in some examples about 0.2% to about 0.8% by weight of the solids of the LEP ink composition.

In some examples, the charge director is present in an amount of from about 3 mg/g to about 20 mg/g, in some examples from about 3 mg/g to about 15 mg/g, in some examples from about 10 mg/g to about 15 mg/g, in some examples from about 5 mg/g to about 10 mg/g (where mg/g indicates mg per gram of solids of the LEP ink composition).

Other Additives

The LEP ink composition may include another additive or a plurality of other additives. The other additive or plurality of other additives may be added at any stage of the method. The other additive or plurality of other additives may be selected from a charge adjuvant, a wax, a surfactant, viscosity modifiers, and compatibility additives. The wax may be an incompatible wax. As used herein, "incompatible wax" may refer to a wax that is incompatible with the resin. Specifically, the wax phase separates from the resin phase upon the cooling of the resin fused mixture on a print substrate during and after the transfer of the ink film to the print substrate, e.g. from an intermediate transfer member, which may be a heated blanket.

In some examples, the LEP ink composition includes a charge adjuvant. A charge adjuvant may promote charging of the particles when a charge director is present. The method as described herein may involve adding a charge adjuvant at any stage. The charge adjuvant can include, for example, barium petronate, calcium petronate, Co salts of naphthenic acid, Ca salts of naphthenic acid, Cu salts of naphthenic acid, Mn salts of naphthenic acid, Ni salts of naphthenic acid, Zn salts of naphthenic acid, Fe salts of naphthenic acid, Ba salts of stearic acid, Co salts of stearic acid, Pb salts of stearic acid, Zn salts of stearic acid, Al salts of stearic acid, Zn salts of stearic acid, Cu salts of stearic acid, Pb salts of stearic acid, Fe salts of stearic acid, metal carboxylates (e.g., Al tristearate, Al octanoate, Li heptanoate, Fe stearate, Fe distearate, Ba stearate, Cr stearate, Mg octanoate, Ca stearate, Fe naphthenate, Zn naphthenate, Mn heptanoate, Zn heptanoate, Ba octanoate, Al octanoate, Co octanoate, Mn octanoate, and Zn octanoate), Co lineolates, Mn lineolates, Pb lineolates, Zn lineolates, Ca oleates, Co oleates, Zn palmirate, Ca resinates, Co resinates, Mn resinates, Pb resinates, Zn resinates, AB diblock copolymers of 2-ethylhexyl methacrylate-co-methacrylic acid calcium and ammonium salts, copolymers of an alkyl acrylamidoglycolate alkyl ether (e.g., methyl acrylamidoglycolate methyl ether-co-vinyl acetate), and hydroxy bis(3,5-di-tert-butyl salicylic) aluminate monohydrate. In an example, the charge adjuvant is or includes aluminum di- or tristearate. In some examples, the charge adjuvant is VCA (an aluminium distearate, available from Sigma Aldrich).

The charge adjuvant may be present in an amount of about 0.1 to about 5% by weight, in some examples about 0.1 to about 1% by weight, in some examples about 0.3 to about 0.8% by weight of the solids of the LEP ink composition, in some examples about 1 wt % to about 3 wt % of the solids of the LEP ink composition, in some examples about 1.5 wt % to about 2.5 wt % of the solids of the LEP ink composition.

The charge adjuvant may be present in an amount of less than about 5.0% by weight of total solids of the LEP ink composition, in some examples in an amount of less than about 4.5% by weight, in some examples in an amount of less than about 4.0% by weight, in some examples in an amount of less than about 3.5% by weight, in some examples in an amount of less than about 3.0% by weight, in some examples in an amount of less than about 2.5% by weight, in some examples about 2.0% or less by weight of the solids of the LEP ink composition.

In some examples, the LEP ink composition further includes, e.g. as a charge adjuvant, a salt of multivalent cation and a fatty acid anion. The salt of multivalent cation and a fatty acid anion can act as a charge adjuvant. The multivalent cation may, in some examples, be a divalent or a trivalent cation. In some examples, the multivalent cation is selected from Group 2, transition metals and Group 3 and Group 4 in the Periodic Table. In some examples, the multivalent cation includes a metal selected from Ca, Sc, Ti, V, Cr, Mn, Fe, Co, Ni, Cu, Zn, Al and Pb. In some examples, the multivalent cation is $Al^{3+}$. The fatty acid anion may be selected from a saturated or unsaturated fatty acid anion. The fatty acid anion may be selected from a $C_8$ to $C_{26}$ fatty acid anion, in some examples a $C_{14}$ to $C_{22}$ fatty acid anion, in some examples a $C_{16}$ to $C_{20}$ fatty acid anion, in some examples a $C_{17}$, $C_{18}$ or $C_{19}$ fatty acid anion. In some examples, the fatty acid anion is selected from a caprylic acid anion, capric acid anion, lauric acid anion, myristic acid anion, palmitic acid anion, stearic acid anion, arachidic acid anion, behenic acid anion and cerotic acid anion.

The charge adjuvant, which may, for example, be or include a salt of a multivalent cation and a fatty acid anion, may be present in an amount of about 0.1 wt % to about 5 wt % of the solids of the LEP ink composition, in some examples in an amount of about 0.1 wt % to about 2 wt % of the solids of the LEP ink composition, in some examples in an amount of about 0.1 wt % to about 2 wt % of the solids of the LEP ink composition, in some examples in an amount of about 0.3 wt % to about 1.5 wt % of the solids of the LEP ink composition, in some examples about 0.5 wt % to about 1.2 wt % of the solids of the LEP ink composition, in some examples about 0.8 wt % to about 1 wt % of the solids of the LEP ink composition, in some examples about 1 wt % to about 3 wt % of the solids of the LEP ink composition, in some examples about 1.5 wt % to about 2.5 wt % of the solids of the LEP ink composition.

Method for Producing a LEP Ink Composition

Also provided is a method of providing a security LEP ink. The method may comprise:

providing a luminescent component; and combining the luminescent component with a resin and a carrier liquid.

The luminescent component may be colourless. As discussed above, the LEP ink composition may be colourless. The LEP ink composition may be colourless and transparent. As discussed above, the LEP ink composition may be invisible to the human eye under visible light and emit visible light on exposure to IR light.

The method may comprise selecting a luminescent component having an excitation wavelength in the IR range, for example as discussed above, such that the luminescent component emits visible light, for example visible light having a pre-selected wavelength, i.e. colour. Therefore, the luminescent component may be selected such that a particular colour of visible light is emitted on exposure to IR light, for example on exposure to IR light having a pre-selected wavelength. In some examples the luminescent component may be selected to emit a particular colour of visible light on exposure to IR light having a wavelength in the range of about 700 nm to about 1500 nm, for example about 750 nm to about 1500 nm, about 800 nm to about 1100 nm, or about 980 nm. In some examples the luminescent component may be selected to emit a particular colour of visible light on exposure to IR light having an intensity of about 1 $mW/mm^2$ or greater, for example about 2 $mW/mm^2$ or greater, about 5 $mW/mm^2$ or greater, about 10 $mW/mm^2$ or greater, about 25 $mW/mm^2$ or greater, about 30 $mW/mm^2$ or greater, about 50 $mW/mm^2$ or greater, about 100 $mW/mm^2$ or greater, or about 200 $mW/mm^2$ or greater.

In some examples, the method comprising providing a first luminescent component and a second luminescent component, wherein the first luminescent component and the second luminescent component are selected to provide a LEP ink composition having pre-selected emission spectrum on exposure to IR light. In some examples, the first luminescent component emits visible light having a first wavelength and the second luminescent component emits visible light having a second wavelength on exposure to IR light. In some examples the first wavelength and the second wavelength are different. In some examples, the first luminescent component and the second luminescent component emit visible light of different colours on exposure to the same IR light source. A LEP ink composition, or a LEP image printed therefrom, comprising a first luminescent component and a second luminescent component may emit visible light having the combined emission spectrum of the first and second luminescent component on exposure to IR light.

In some examples the method of providing a LEP ink composition comprises combining a resin and a luminescent component, to form ink particles and dispersing the ink particles in a carrier liquid to form an electrostatic ink composition.

In some examples, forming the ink particles comprises grinding the resin and luminescent component in the presence of a carrier liquid. In some examples, the resin and luminescent component are ground in the present of a carrier liquid and a charge adjuvant such as VCA. In some examples, additional carrier liquid may then be added to the composition. In some examples, the method comprises adding a charge director to the composition comprising ink particles dispersed in a carrier liquid.

Printing Process and Print Substrate

Also provided is a method for printing security information. The method may comprise:

providing a LEP ink composition comprising:

a luminescent component which emits visible light on exposure to IR light;

a resin; and a carrier liquid; and liquid electrophotographically printing the selected LEP ink onto a print substrate to provide a security LEP image disposed on the print substrate, wherein the security LEP image is invisible to the human eye when viewed under visible light.

In some examples, the method comprises providing a plurality of LEP ink compositions, where each LEP ink composition is selected to emit visible light of a different wavelength on exposure to IR light. For example, each of the plurality of LEP ink compositions may comprise a different luminescent component which emits visible light of a different wavelength (i.e. different colour) to each of the luminescent components of each of the other of the plurality of LEP ink compositions on exposure to IR light, e.g. on exposure to IR light having the same wavelength (e.g. wavelength range) and/or intensity. In some examples, the method comprises providing a plurality of LEP ink compositions wherein each LEP ink composition is selected to emit visible light of a different wavelength on exposure to IR light having a pre-selected wavelength, for example IR light having 700 nm to about 1500 nm, for example about 750 nm to about 1500 nm, about 800 nm to about 1100 nm, about 940 nm to about 1060 nm, or about 980 nm. Therefore, a plurality of LEP ink compositions, each LEP ink composition comprising a different luminescent component, may be used to print full colour hidden visible colour images such that the full colour LEP image is only visible to the human eye when irradiated with IR light, for example IR light having a pre-selected wavelength.

A LEP image may be produced using a plurality of LEP ink compositions such that the visible light emitted from the LEP image on exposure to IR light is the combined emission spectrum of the luminescent component of each of the plurality of LEP ink compositions.

In some examples, the method may comprise printing a plurality of LEP ink compositions to form an image on a print substrate, the image emitting different wavelengths of visible light on exposure to IR light. Each of the plurality of different LEP ink compositions may comprise a different luminescent component. Each of the different luminescent components may have a different excitation wavelength and/or emission spectrum compared to each of the other luminescent components. In some examples, each of the different luminescent components may have the same excitation wavelength, for example about 700 nm to about 1500 nm, about 750 nm to about 1500 nm, about 800 nm to about 1100 nm, about 940 nm to about 1060 nm, or about 980 nm, and different emission spectrums such that each of the LEP ink compositions or LEP images printed therefrom emits a different colour of visible light on exposure to the same IR light source, for example an IR laser.

In some examples, the method may comprise providing a red LEP ink composition, a green LEP ink composition and a blue LEP ink composition, wherein the red LEP ink composition comprises a luminescent component which absorbs IR light and emits red light, the green LEP ink composition comprises a luminescent component that absorbs IR light and emits green light and the blue LEP ink composition comprises a luminescent component which absorbs IR light and emits blue light. In some examples, the method may comprise liquid electrostatically printing the red, green and blue LEP ink compositions to produce a LEP image which is invisible when viewed under visible light and emits red, green and blue light on exposure to IR light to provide a full-colour LEP image.

The method may comprise selecting a visible wavelength at which the LEP image is to be detected on exposure to IR light, e.g. IR light having a pre-selected IR wavelength.

The method may comprise selecting a LEP ink composition or a combination of LEP ink compositions to provide a printed LEP image which emits pre-selected visible light wavelength on exposure to IR light, e.g. IR light having a pre-selected IR wavelength.

The method for printing security information may comprise:

- providing a liquid electrostatic ink composition as described herein;
- contacting the electrostatic ink composition with a latent electrostatic image on a surface to create a developed image; and
- transferring the developed image to a print substrate, in some examples via an intermediate transfer member.

In some examples, the surface on which the (latent) electrostatic image is formed or developed may be on a rotating member, e.g. in the form of a cylinder. The surface on which the (latent) electrostatic image is formed or developed may form part of a photo imaging plate (PIP). The method may involve passing the electrostatic ink composition between a stationary electrode and a rotating member, which may be a member having the surface having the (latent) electrostatic image thereon or a member in contact with the surface having the (latent) electrostatic image thereon. A voltage is applied between the stationary electrode and the rotating member, such that particles adhere to the surface of the rotating member. The intermediate transfer member, if present, may be a rotating flexible member, which may be heated, e.g. to a temperature of from 80 to 160° C.

The present disclosure also provides a LEP ink composition producible according to the method described herein. There may also be provided a print substrate having printed thereon a LEP ink composition as described herein and/or producible according to the method described herein.

The print substrate may be any suitable substrate. The substrate may be any suitable substrate capable of having an image printed thereon. The substrate may include a material selected from an organic or inorganic material. The material may include a natural polymeric material, e.g. cellulose. The material may include a synthetic polymeric material, e.g. a polymer formed from alkylene monomers, including, for example, polyethylene and polypropylene, and co-polymers such as styrene-polybutadiene. The polypropylene may, in some examples, be biaxially orientated polypropylene. The material may include a metal, which may be in sheet form. The metal may be selected from or made from, for instance, aluminium (Al), silver (Ag), tin (Sn), copper (Cu), mixtures thereof. In an example, the substrate includes a cellulosic paper. In an example, the cellulosic paper is coated with a polymeric material, e.g. a polymer formed from styrene-butadiene resin. In some examples, the cellulosic paper has an inorganic material bound to its surface (before printing with ink) with a polymeric material, wherein the inorganic material may be selected from, for example, kaolinite or calcium carbonate. The substrate is, in some examples, a cellulosic print substrate such as paper. The cellulosic print substrate is, in some examples, a coated cellulosic print. In some examples, a primer may be coated onto the print substrate, before the electrostatic ink composition is printed onto the print substrate.

The FIGURE shows a schematic illustration of a Liquid Electro Photographic (LEP) printing apparatus which may be used to print a LEP ink composition as described herein. An image, including any combination of graphics, text and images, may be communicated to the LEP printing apparatus 1. According to an illustrative example, in order to print the electrostatic ink composition, firstly, the photo charging unit 2 deposits a uniform static charge on the photo-imaging cylinder 4 and then a laser imaging portion 3 of the photo charging unit 2 dissipates the static charges in selected portions of the image area on the photo-imaging cylinder 4 to leave a latent electrostatic image. The latent electrostatic image is an electrostatic charge pattern representing the image to be printed. The electrostatic ink composition is then transferred to the photo-imaging cylinder 4 by Binary Ink Developer (BID) unit 6. The BID unit 6 presents a uniform film of the electrostatic ink composition to the photo-imaging cylinder 4. A resin component of the electrostatic ink composition may be electrically charged by virtue of an appropriate potential applied to the electrostatic ink composition in the BID unit. The charged resin component, by virtue of an appropriate potential on the electrostatic image areas, is attracted to the latent electrostatic image on the photo-imaging cylinder 4 (first transfer). The LEP ink composition does not adhere to the uncharged, non-image areas and forms an image on the surface of the latent electrostatic image. The photo-imaging cylinder 4 then has a developed electrostatic ink composition image on its surface.

The image is then transferred from the photo-imaging cylinder 4 to the intermediate transfer member (ITM) 8 by virtue of an appropriate potential applied between the photo-imaging cylinder 4 and the ITM 8, such that the charged electrostatic ink composition is attracted to the ITM 8 (second transfer). The image is then dried and fused on the ITM 8 before being transferred to a print substrate 10.

Between the first and second transfers the solid content of the LEP ink composition image is increased and the LEP ink composition is fused on to the ITM 8. For example, the solid content of the LEP ink composition image deposited on the ITM 8 after the first transfer may be around 20%, by the second transfer the solid content of the image may be around 80-90%. This drying and fusing may be achieved by using elevated temperatures and air flow assisted drying. In some examples, the ITM 8 is heatable.

EXAMPLES

The following illustrates examples of the compositions and related aspects described herein. Thus, these examples should not be considered to restrict the present disclosure, but are merely in place to teach how to make examples of compositions of the present disclosure.

Materials

Resins:

NUCREL® 699 (Dupont): a copolymer of ethylene and methacrylic acid, made with nominally 11 wt % methacrylic acid.

AC-5120 (Honeywell): ethylene-acrylic acid copolymer with an acid number of 112-130 KOH/g.

Carrier Liquid:

ISOPAR™ L (available form EXXON): an isoparafinic oil (the carrier liquid).

Charge Adjuvant:

VCA (available from Sigma-Aldrich): an aluminium distearate.

Charge Director:

NCD: a natural charge director having the components (i) natural soya lecithin, (ii) basic barium petronate, and (iii) dodecyl benzene sulphonic acid, amine salt, with the components (i), (ii) and (iii) being present in the weight ratios of 6.6%:9.8:3.6%.

Luminescent Components:

LLRS1(Red) (available from VerifyMe) emits red visible light on exposure IR light having a wavelength in the range of about 940-1060 nm.

LLRS3(Green) (available from VerifyMe) emits green visible light on excitation by IR light having a wavelength in the range of about 940-1060 nm.

LUUPC1(Red) (available from Luinochem) emits red visible light on excitation by IR light having a wavelength in the range of about 940-1060 nm.

LUUPC2(Green) (available from Luinochem) emits green visible light on excitation by IR light having a wavelength in the range of about 940-1060 nm.

LUUPC3(Blue) (available from Luinochem) emits blue visible light on excitation by IR light having a wavelength of 940-1060 nm.

Standard Procedure

A paste was formed by mixing the resins NUCREL® 699 and AC-5120 (ratio of 4:1) at 40 wt. % NVS in the presence of a carrier liquid (ISOPAR™ L) in a Ross mixer (Model DPM-2, obtained from Charles Ross & Son Company—Hauppauge N.Y.) at 120-150° C. and 50 rpm for 90 min., and then the RPM was raised to 70 for 120 min. Subsequently, the temperature was lowered to room temperature and, after 30 min, the RPM was lowered to 50. A paste was obtained.

A luminescent component was ground with the paste at a ratio of 1:3 (luminescent component:paste) by weight for 8 h in the presence of 2 wt. % VCA in a ceramic attritor (Union Process Attritor system—a batch-type Szegvari attritor system with a mill size of 1 gallon), without any prior treatment. The overall amount of material in the attritor system was 1700 g and the attritor was used at 26° C./45° C. and 250 rpm.

The ground material was then diluted with ISOPAR™ L to form a 2 wt. % NVS working dispersion and NCD added (5.5 mg/l g ISOPAR™).

Example 1

A liquid electrophotographic (LEP) ink was formulated using LLRS1(Red) as the luminescent component in the general procedure described above.

Example 2

A liquid electrophotographic (LEP) ink was formulated using LLRS3 (Green) as the luminescent component in the general procedure described above.

Example 3

A liquid electrophotographic (LEP) ink was formulated using LUUPC1(Red) as the luminescent component in the general procedure described above.

Example 4

A liquid electrophotographic (LEP) ink was formulated using LUUPC2(Green) as the luminescent component in the general procedure described above.

Example 5

A liquid electrophotographic (LEP) ink was formulated using LUUPC3(Blue) as the luminescent component in the general procedure described above.

Each of the liquid electrophotographic inks produced in Examples 1-5 was printed onto standard paper using an Indigo 6000 or 7000 series LEP printing press. Each of the LEP ink compositions was printed to provide LEP images having a thickness of about 1 μm. The LEP images were invisible to the human eye when viewed under visible light (the LEP images were also invisible to the human eye when viewed under UV light) and emitted visible light, which was visible to the human eye, on exposure to IR light (provided using an IR laser (200 mW 980 nm Handheld Infrared Laser Pointer obtained from LaserTo) providing IR light having a wavelength in the range 940-1060 nm and an intensity of about 30 mW/mm$^2$.

While the LEP ink compositions, methods and related aspects have been described with reference to certain examples, it will be appreciated that various modifications, changes, omissions, and substitutions can be made without departing from the spirit of the disclosure. It is intended, therefore, that the LEP ink compositions, methods and related aspects be limited only by the scope of the following claims. Unless otherwise stated, the features of any dependent claim can be combined with the features of any of the other dependent claims, and any other independent claim.

The invention claimed is:

1. A security liquid electrophotographic (LEP) ink composition comprising:

a luminescent component comprising a transition metal oxide, a transition metal hydroxide, a transition metal hydride, a transition metal halide, or a combination thereof;

a resin; and a carrier liquid, wherein the LEP ink composition is colourless when viewed under visible light and luminesces to emit visible light on exposure to IR light.

2. The LEP ink composition according to claim 1, wherein the luminescent component absorbs IR light having a wavelength in the range of 940 nm to 1060 nm.

3. The LEP ink composition according to claim 1, wherein the luminescent component emits visible light on exposure to IR light having an intensity above a threshold value.

4. The LEP ink composition according to claim 3, wherein the threshold value for the intensity of IR light is 1 $mW/mm^2$ or greater.

5. The LEP ink composition according to claim 1 which forms a LEP image which is invisible to the human eye.

6. The LEP ink composition according to claim 1, further comprising a charge director.

7. The LEP ink composition according to claim 1, wherein the resin comprises a copolymer of an alkylene monomer and an acrylic acid monomer or a methacrylic acid monomer.

8. A method of providing a security liquid electrophotographic (LEP) ink composition, the method comprising:

providing a first luminescent component and a second luminescent component, wherein the first luminescent component and the second luminescent component are selected to provide a LEP ink composition having pre-selected emission spectrum on exposure to IR light; and combining the first luminescent component and the second luminescent component with a resin and a carrier liquid to provide a LEP ink composition which is colourless when viewed under visible light.

9. The method according to claim 8, wherein the first luminescent component or the second luminescent component is selected to emit visible light at a pre-selected wavelength on exposure to IR light.

10. A method of printing a security LEP image, the method comprising:

providing the LEP ink composition of claim 8;

liquid electrophotographically printing the LEP ink composition onto a print substrate to provide a security LEP image disposed on the print substrate, wherein the security LEP image is invisible to the human eye when viewed under visible light.

11. A security liquid electrophotographic (LEP) ink composition comprising:

a luminescent component;

a resin; and a carrier liquid;

wherein the LEP ink composition is colourless when viewed under visible light and luminesces to emit visible light on exposure to IR light;

and wherein the luminescent component includes a Cu(I) complex, a Cu(II) complex, a Cr(III) complex, a Re(I) complex, a Re(III) complex, a Ru(II) complex, an Os(II) complex, an Ir(III) complex, a Pt(II) complex, a Pd(II) complex, an Au(I) complex, or an Au(III) complex.

* * * * *